US006116075A

United States Patent [19]

Sofy

[11] Patent Number: 6,116,075

[45] Date of Patent: Sep. 12, 2000

[54] TRANSFER BAR ATTACHMENT

[75] Inventor: Hugh Sofy, Troy, Mich.

[73] Assignee: HMS Products Co., Troy, Mich.

[21] Appl. No.: 09/306,575

[22] Filed: May 6, 1999

[51] Int. Cl.[7] ..... B21D 43/05

[52] U.S. Cl. ..... 72/405.16; 72/405.11; 72/405.01; 198/621.1

[58] Field of Search ..... 72/405.01, 405.13–405.16, 72/405.09, 405.11; 198/621.1–621.4

[56] References Cited

U.S. PATENT DOCUMENTS

| | | | |
|---|---|---|---|
| Re. 34,581 | 4/1994 | Sofy et al. | 72/405 |
| 4,513,602 | 4/1985 | Sofy | 72/405 |
| 4,586,364 | 5/1986 | Berger | 72/405.11 |
| 4,833,908 | 5/1989 | Sofy | 72/405 |
| 4,852,381 | 8/1989 | Sofy | 72/405 |
| 4,895,013 | 1/1990 | Sofy | 72/405 |
| 5,003,808 | 4/1991 | Maher | 72/405.13 |
| 5,680,787 | 10/1997 | Fisch | 72/405.16 |
| 5,899,109 | 5/1999 | Fisch | 72/405.16 |

*Primary Examiner*—Daniel C. Crane
*Attorney, Agent, or Firm*—Howard & Howard

[57] ABSTRACT

A device for releasably mounting a transfer bar (12) to the distal end (14) of a horizontal link (16) of a transfer press (18) includes a clamping mechanism (10) mounted to the distal end (14) of the horizontal link (16) for providing a pocket that supports the transfer bar (12). The clamping mechanism (10) includes a bore (20) for receiving the distal end (14) of the horizontal link (16) and a locking means for preventing relative movement between the clamping mechanism (10) and the horizontal link (16). The locking means comprises a key (22) for preventing rotation of the clamping mechanism (10) about the horizontal link (16). The clamping mechanism (10) defines a clamp which includes a threaded fastener (24) for tightening the clamp and locking the clamping mechanism (10) onto the distal end (14) of the horizontal link (16). The clamping mechanism (10) is substantially U-shaped for providing a pocket to hold the transfer bar (12), and includes a pin (26) that extends through the clamping mechanism (10) for retaining the transfer bar (12) in the pocket.

20 Claims, 2 Drawing Sheets

TRANSFER BAR ATTACHMENT

BACKGROUND OF THE INVENTION

1. Field of the Invention

The present invention relates to a clamping mechanism for releasably mounting a transfer bar to a transfer press.

2. Description of the Prior Art

Transfer machines used to move parts from station to station between presses are well known in the industry. Transfer machines of this type include a mechanism to provide motion to a pair of horizontal links that in turn provide motion to a transfer bar. The transfer bar mounts at the end of the horizontal links and includes specialized tooling that is designed to engage and hold a specific type of work piece. Typically, two such transfer machines are positioned opposite each other and the transfer bars are driven to extend, and grab the work piece between opposing pairs of tooling mounted on the transfer bars. When the tooling has been extended and the work piece engaged, the horizontal links move the transfer bar up vertically, forward horizontally, and downward into the next press station. The horizontal links then retract the transfer bar and disengage the tooling from the work piece and return the transfer bar to a starting position. This method of transferring work pieces between stations is well known in the art and described in U.S. Pat. Nos. 4,833,908 and RE. 34,581.

Depending on the size and material of the work piece, the tooling and the transfer bar required to carry the tooling can be heavy and difficult to handle. The tooling must be designed to engage and hold a specific type of work piece, therefore the tooling is specialized and can only be used with a particular work piece. That means when a different type of work piece is to be processed, the tooling on the transfer bar must be changed. This process is time consuming, as there may be many pairs of tools to change. An alternative is to change the entire transfer bar. This raises difficulties due to the weight of the transfer bar and the tooling. The transfer bar must be mounted securely to the horizontal links to insure that the weight of the transfer bar and the tooling mounted to the transfer bar will be adequately supported. One method of attachment is to simply bolt the transfer bar onto the end of the horizontal links. Typically, this is done by inserting the distal end of the horizontal link into an opening in the transfer bar. In order to accommodate the horizontal link, and maintain the structural integrity of the transfer bar, an insert is welded within the transfer bar. The end of the horizontal link fits within the insert, and a bolt holds the transfer bar onto the end of the horizontal link. The tolerance fit between the insert and the horizontal link is very tight, so the alignment of the insert and the horizontal link must be nearly perfect to allow the transfer bar to be mounted. Due to the size and weight of the transfer bar and tooling, aligning the transfer bar is awkward and time consuming.

SUMMARY OF THE INVENTION AND ADVANTAGES

A clamping mechanism for supporting a transfer bar to the distal end of a horizontal link of a transfer press characterized by presenting a pocket for releasably supporting the transfer bar.

The present invention will allow a transfer machine to be changed over for processing different work pieces by providing a clamping mechanism for mounting the transfer bar to the transfer machine that allows the transfer bar to be removed and replaced quickly and safely.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
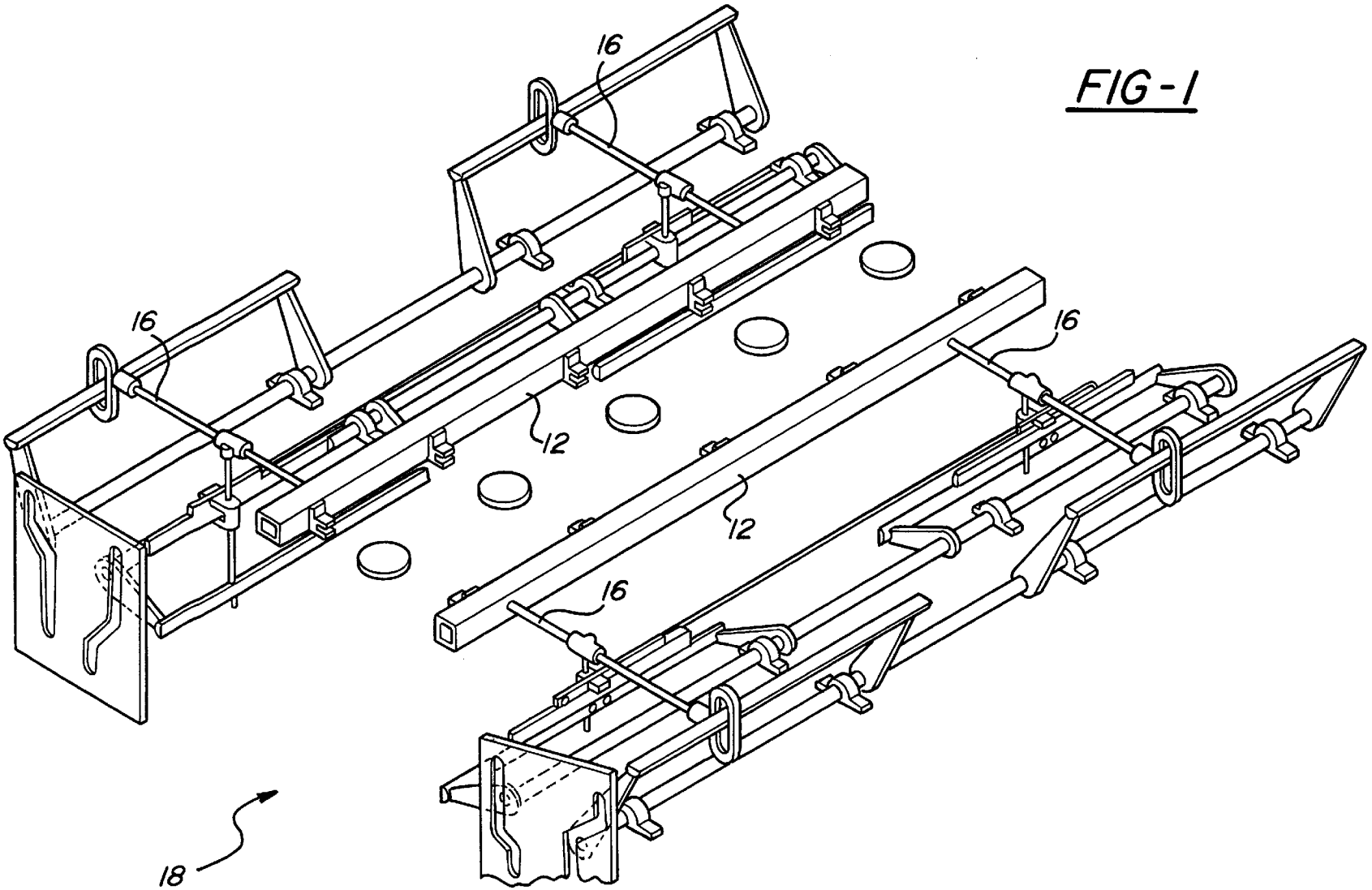
FIG. 1 is a perspective view of a transfer press with transfer bars attached thereto.
Figure 2:
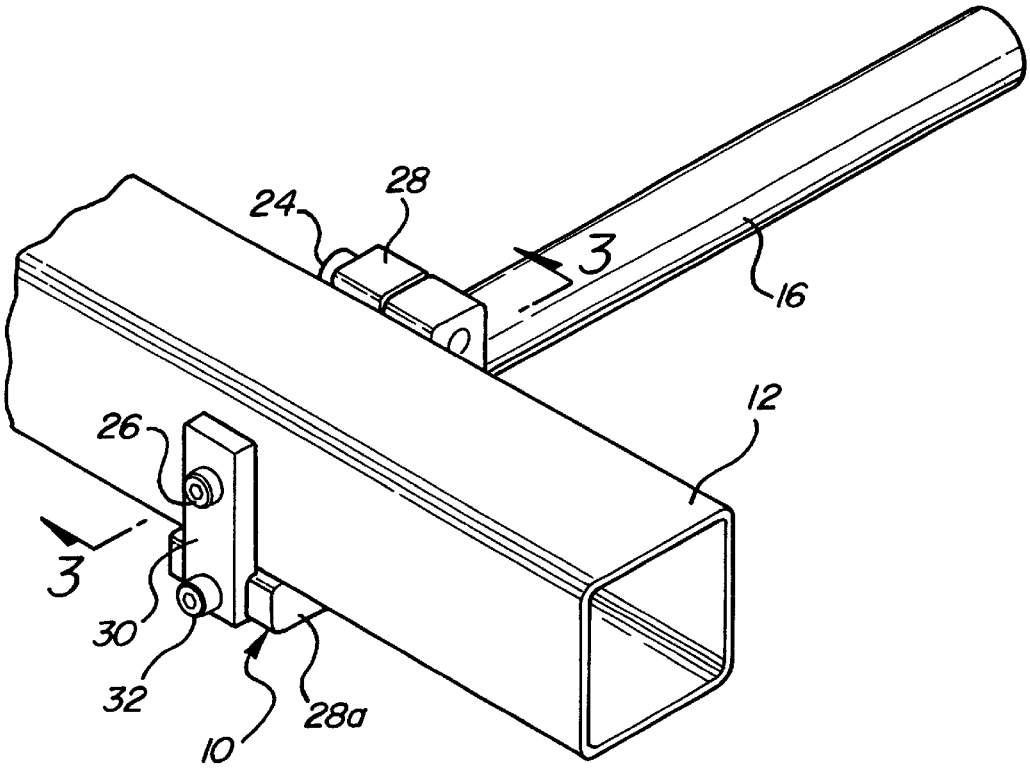
FIG. 2 is a view of the clamping mechanism mounted to the end of the horizontal link and supporting a transfer bar.
Figure 3:
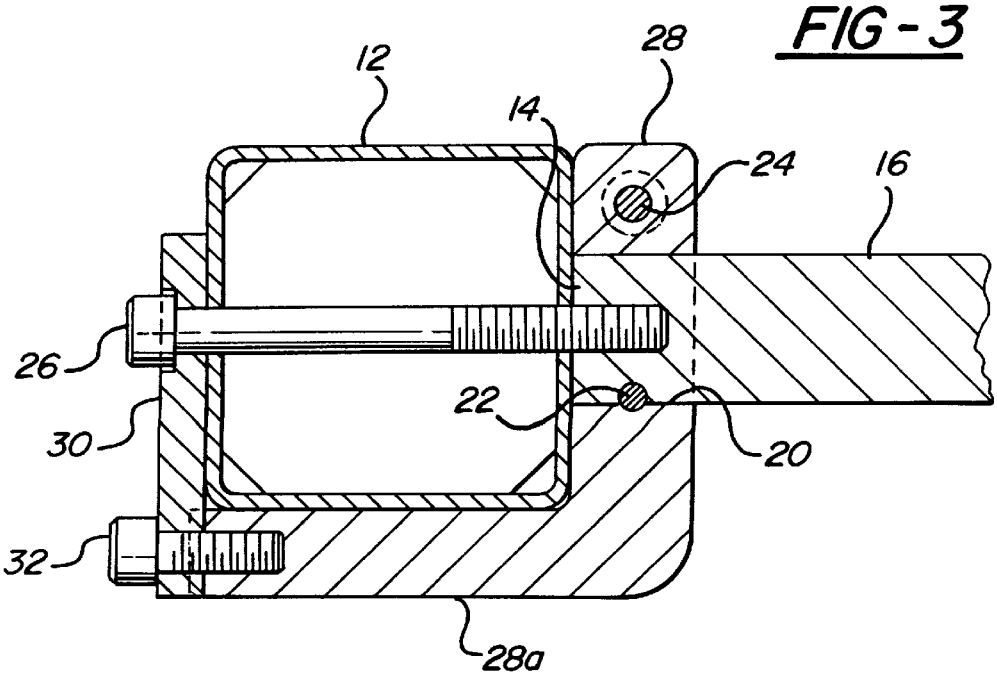
FIG. 3 is a cross sectional view of the clamping mechanism taken along line 3—3 of FIG. 2.

Referring to the FIGURES, wherein like numerals indicate like or corresponding parts throughout the several views, a clamping mechanism is generally shown at 10 for releasably mounting a transfer bar 12 to the distal end 14 of a horizontal link 16 of a transfer press 18. The clamping mechanism 10 is mounted to the distal end 14 of the horizontal link 16 for providing a pocket that supports the transfer bar 12. The clamping mechanism 10 includes a bore 20 for receiving the distal end 14 of the horizontal link 16 and a locking means for preventing relative movement between the clamping mechanism 10 and the horizontal link 16. In the preferred embodiment, the locking means comprises a key 22 for preventing rotation of the clamping mechanism 10 about the horizontal link 16, and the clamping mechanism 10 defines a clamp which includes a threaded fastener 24 for tightening the clamp and locking the clamping mechanism 10 onto the distal end 14 of the horizontal link 16.

The clamping mechanism 10 is substantially U-shaped for providing a pocket to hold the transfer bar 12, and includes a pin 26 that extends through the clamping mechanism 10 for retaining the transfer bar 12 in the pocket. In the preferred embodiment, the clamping mechanism 10 presents two vertical legs that define opposite sides of the pocket. The first vertical leg 28 includes the bore 20 for receiving the distal end 14 of the horizontal link 16, and further includes a portion 28*a* that extends horizontally outward to form the bottom of the U-shaped pocket. The second vertical leg 30 is attached by a bolt 32 to and extends vertically from the bottom of the U-shaped pocket. The pin 26 extends through the second vertical leg 30, through the transfer bar 12, and threads into the distal end 14 of the horizontal link 16 clamped within the bore 20 in the first vertical leg 28.

The preferred application of the clamping mechanism 10 is in conjunction with a transfer press. Transfer presses that would be suitable to utilize the clamping mechanism 10 are well known to those skilled in the art and as described in U.S. Pat. Nos. 4,833,908 and RE. 34,581.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A clamping mechanism (10) for supporting a transfer bar (12) to the distal end (14) of a horizontal link (16) of a transfer press (18), said clamping mechanism (10) characterized by presenting a pocket of releasably supporting the transfer bar (12), and a (20) bore for receiving the distal end (14) of the horizontal link (16).

2. A clamping mechanism (10) as set forth in claim 1 including locking means for preventing relative movement between said clamping mechanism (10) and the horizontal link (16).

3. A clamping mechanism (10) as set forth in claim 2 wherein said locking means comprises a key (22) for preventing rotation of said clamping mechanism (10) about the horizontal link (16).

4. A clamping mechanism (10) as set forth in claim 2 wherein said locking means includes a clamp defined by said clamping mechanism (10) and a threaded fastener (24) for clamping said clamping mechanism (10) to the horizontal link (16).

5. A clamping mechanism (10) as set forth in claim 2 wherein said clamping mechanism (10) is U-shaped for defining said pocket.

6. A clamping mechanism (10) as set forth in claim 5 including a pin (26) extending through said clamping mechanism (10) for retaining the transfer bar (12) in said pocket.

7. A clamping mechanism (10) as set forth in claim 6 wherein said U-shaped clamping mechanism (10) presents two vertical legs (28, 30) defining opposite sides of said pocket, said pin (26) extends through said legs (28, 30) for engaging the distal end (14) of the horizontal link (16).

8. A clamping mechanism (10) as set forth in claim 7 wherein said pin (26) is threaded for threadably engaging the distal end (14) of the horizontal link (16).

9. A clamping mechanism (10) as set forth in claim 8 wherein said clamping mechanism (10) includes first and second components with said first component defining a first leg (28) having said bore (20) therein and a bottom (**28*a*) of said U-shape extending horizontally from said first leg (28), and said second component extends vertically from said bottom (28*a*) to define said second leg (30**).

10. A clamping mechanism (10) as set forth in claim 9 including a bolt (32) securing said second leg (30) to said bottom (**28*a*) of said first leg (28**).

11. A work piece transfer assembly (18) comprising; a transfer bar (12), and a pair of horizontal links (16) for transmitting motion to said transfer bar (12);

said work piece transfer assembly (18) characterized by a clamping mechanism (10) mounted to a distal end (14) of said horizontal link (16) and providing a pocket for releasably supporting said transfer bar (12), and a bore (20), said distal end (14) of said horizontal link (16) extending into said bore (20).

12. A work piece transfer assembly (18) as set forth in claim 11 wherein said clamping mechanism (10) includes a locking means for preventing relative movement between said clamping mechanism (10) and said horizontal link (16).

13. A work piece transfer assembly (18) as set forth in claim 12 wherein said locking means comprises a key (22) for preventing rotation of said clamping mechanism (10) about said horizontal link (16).

14. A work piece transfer assembly (18) as set forth in claim 12 wherein said locking means includes a clamp defined by said clamping mechanism (10) and a threaded fastener (24) for clamping said clamping mechanism (10) to said horizontal link (16).

15. A work piece transfer assembly (18) as set forth in claim 12 wherein said clamping mechanism (10) is U-shaped for defining said pocket.

16. A work piece transfer assembly (18) as set forth in claim 15 wherein a pin (26) extends through said clamping mechanism (10) for retaining said transfer bar (12) in said pocket.

17. A work piece transfer assembly (18) as set forth in claim 16 wherein said U-shaped clamping mechanism (10) presents two vertical legs (28,30) defining opposite sides of said pocket, said pin (26) extending through said legs (28, 30) for engaging said distal end (14) of said horizontal link (16).

18. A work piece transfer assembly (18) as set forth in claim 17 wherein said pin (26) is threaded for threadably engaging said distal end (14) of said horizontal link (16).

19. A work piece transfer assembly (18) as set forth in claim 18 wherein said clamping mechanism (10) includes first and second components with said first component defining a first leg (28) having said bore (20) therein and a bottom (**28*a*) of said U-shape extending horizontally from said first leg (28), and said second component extends vertically from said bottom (28*a*) to define said second leg (30**).

20. A work piece transfer assembly (18) as set forth in claim 19 wherein said clamping mechanism (10) includes a bolt (32) securing said second leg (30) to said bottom (**28*a*) of said first leg (28**).

* * * * *